United States Patent [19]

Phillips, Jr. et al.

[11] 4,273,312

[45] Jun. 16, 1981

[54] METHOD OF PROCESS OFF-GAS CONTROL

[75] Inventors: William R. Phillips, Jr.; Ronald D. Tate, both of Denver; Radon Tolman, Evergreen, all of Colo.

[73] Assignee: Dravo Corporation, Pittsburgh, Pa.

[21] Appl. No.: 22,770

[22] Filed: Mar. 22, 1979

[51] Int. Cl.[3] ..... C22B 15/06

[52] U.S. Cl. ..... 266/44; 55/210; 75/76; 266/78; 266/144; 266/158

[58] Field of Search ..... 75/60, 72–76, 75/93 R, 93 E; 266/44, 46, 47, 78, 80–85, 89, 90, 144, 158, 217–226; 55/210

[56] References Cited

U.S. PATENT DOCUMENTS

| | | | |
|---|---|---|---|
| 1,809,326 | 6/1931 | Austin et al. | 75/20 R |
| 3,058,815 | 10/1962 | Davis | 23/255 |
| 3,100,699 | 8/1963 | Bogdandy et al. | 75/59 |
| 3,153,587 | 10/1964 | Schuerger | 266/80 |
| 3,218,158 | 11/1965 | Dumont-Fillon | 266/89 |
| 3,520,657 | 7/1970 | Frumerman | 23/230 |
| 3,522,035 | 7/1970 | Putman | 266/158 |
| 3,719,811 | 3/1973 | Munson | 235/151.12 |
| 3,871,871 | 3/1975 | Demis et al. | 75/60 |
| 3,908,969 | 9/1975 | Baum | 266/158 |
| 4,040,789 | 8/1977 | Voss et al. | 23/230 A |
| 4,045,212 | 8/1977 | Hodes | 75/40 |
| 4,155,725 | 5/1979 | Van Ackeren et al. | 266/158 |

FOREIGN PATENT DOCUMENTS

| | | | |
|---|---|---|---|
| 751721 | 11/1970 | Belgium | 266/44 |
| 942951 | 3/1974 | Canada . | |

OTHER PUBLICATIONS

Jorgensen, R.; *Fan Engineering* 7th Edition, Buffalo Forge Co. pp. 258–271.

*Primary Examiner*—Michael L. Lewis

*Attorney, Agent, or Firm*—Parmelee, Miller, Welsh & Kratz

[57] ABSTRACT

A method of controlling a process off-gas system by generating a model of the input to the system as a function of the gas generating inputs to the process vessel served by the off-gas system and feeding forward this flow representation as the set point for a feedback flow control loop for the downstream off-gas system fans. The feed forward signal is trimmed by a process off-gas pressure feedback loop which when applied to a TBRC off-gas system assures a minimum flow of leakage air to prevent puffing. The flow control feedback loop employs a mass spectrometer to provide on line computation of the true off-gas flow at the fans. Since the input model can be generated as a simple linear function of the SCFM of the gas generating inputs to the process, the flow control loop is operated on the same basis although it can also be operated on the basis of mass flow.

11 Claims, 2 Drawing Figures

METHOD OF PROCESS OFF-GAS CONTROL

FIELD OF THE INVENTION

This invention relates to a method for controlling a process off-gas system and more particularly to such a method employing feedforward and feedback control techniques to achieve fast, stable and efficient control of the off-gas actual flow rate.

PRIOR ART

In refining metals, for example copper in converters such as top blown rotary converters (TBRC), the gases generated by the process reactions are collected and treated to remove pollutants before being released to the atmosphere. In a typical installation the gases are collected in a hood, circulated through a cooler, passed through a precipitator to remove particulates and then directed through scrubbers, such as venturi and/or tower scrubbers, to remove additional particulates, sulfur dioxide and other pollutants. The remaining gases are reheated and released to the atmosphere through a stack.

Generally the operator controls the inputs to the converter to achieve the desired process reactions. Currently the process off-gas system is operated to monitor some process parameter, typically process pressure, although temperature or a quantative analysis may be used, and to adjust the flow rate of the off-gases through the off-gas system to maintain the selected parameter constant. Several problems are encountered with this type of control.

The most significant of the problems with the current off-gas control systems is caused by the fact that the off-gas is compressible and the final control element affects the control variable through a relatively large volume. This causes a considerable control lag resulting in sluggish control.

A second problem is that the control cannot respond to changes in the inputs to the converter until the control variable is upset. Due to the lag discussed above, the control system must respond to these upsets at a relatively low rate which results in a large system time constant.

For continuous, steady-state processes, the above problems can be tolerated since process upsets are normally small. In batch type processes, however, such as refining copper in a TBRC where the process is frequently interrupted for slagging operations, the control system may never reach set-point using the prior art controls.

Another drawback of the prior art process off-gas systems is the key must be overdriven to assure that the flow rate of the off-gas system at all times exceeds the rate at which process gases are generated. If process gases are generated at a rate which exceeds the flow rate of the off-gas system, process gases leak into the plant environment through the gap between the converter and the hood as a fugitive emision, by-passing any downstream processing and degrading the plant environment. Typically, then the selected value for the controlled variable must be set high enough that ambient air (leakage air) is drawn into the off-gas system through the gap between the converter and the hood no matter what the off-gas system flow is. This requirement results in excessively diluted process off-gas causing decreased process off-gas cleaning system efficiencies, increased power consumption by the process off-gas propelling equipment, and increased process off-gas system load.

The physical properties of the process off-gases contribute to the difficulty of affecting efficient, economical process off-gas control. First, the composition of the gases produced as a byproduct of the process varies randomly with time. Quite often the gas stream is contaminated with particulates, condensable compounds and corrosive compounds. In addition, the flowing temperature of the gases is typically between 300° and 1000° F. which is above the maximum operating temperature of many instruments. The variable composition of the off-gases precludes mass flow control without real-time, comprehensive, quantitative analysis of the gas. The contamination and elevated temperature threaten successful real-time analysis as well as measurement of other vital parameters required for mass flow control.

It is a primary object of the present invention to provide stable high gain control of process leakage flow which is effectively decoupled from the process input flows.

It is also an object of the invention to provide such a control which is adaptable to discontinuous process with minimum operator attention.

Other objects of the invention will be apparent from the detailed description set forth below.

SUMMARY OF THE INVENTION

According to the invention, a process off-gas system is controlled by determining the actual flow rate of the off-gases and adjusting the output of the fan system through feedback control to maintain the flow rate at a set point value. Upon recognizing that one of the major difficulties in providing fast, stable response for an off-gas control system is the substantial lag created by the large volume found in the off-gas treating equipment, such as the cooler and precipitator, disposed in the system between the processing vessel and the fans which propel the gases through the off-gas system, we derived a method for generating a model of the off-gas actual flow as a function of the gas generating inputs to the process vessel and for feeding forward that information as the set point for the flow control loop. In this manner, the fan system can begin responding to the imminent change in off-gas generation long before the change would be detected as a change in conditions at the fans. Under some circumstances, it is advantageous to apply lead compensation to this feed forward set point signal to overdrive the fans and remove gases more quickly from the precipitator and cooler so that the increase in flow in the off-gas system will be effected more quickly at the interface of the process vessel and the off-gas system.

A trim factor can be added to the off-gas flow rate calculated from the process inputs to assure that sufficient flow is created by the off-gas system at all times. In addition the trim factor can be generated through feedback control of a physical property of the off-gases at the process vessel such as by a cascade loop system with the selected physical property of the off-gases at the process vessel as the independent controlled variable and the off-gas flow as the dependent controlled variable. While this can be applied to control of the off-gas temperature in the process vessel, it is most useful for maintaining the pressure of the off-gases in the gap between the vessel and the hood in a TBRC at a minimum value which will assure positive leakage of ambient air into the off-gas system and prevent "puffing" or escape of process gases into the plant environment.

The actual flow rate of the off-gases downstream of the fan is determined by using a mass spectrometer to provide on line indications of the percent concentration of the major constituents of the off-gases. From this information the flow rate at this point in the system can be calculated either in terms of mass flow or SCFM. It is advantageous, however, to use SCFM since we have discovered that by so doing a relatively simple, linear model of the actual rate at which gases are generated by the process being carried out in the process vessel can be generated. This model is based on the discovery that the SCFM of the gases generated in the process vessel are linearly proportional to the SCFM of the gas producing inputs to the process. Thus, the model is constructed by multiplying signals representative of the various inputs by suitable scaling factors and summing the products. If on the other hand mass flow is used, an analysis of the proportional shares of the various gases generated in the reaction vessel must be determined. This would require an additional mass spectometer or time sharing of the mass spectrometer in the flow control loop.

The invention also provides a method for accomodating for discontinuities in the flow of gases into the off-gas system such as would be produced during slagging of a TBRC. In accordance with this feature of the invention, the output of the flow controller is frozen upon the occurrence of the discontinuity and in place of the output of the controller being used to determine the position of the fan final control element a hold signal is substituted. This hold signal has an initial value equal to the output of the controller but it changes smoothly to an interim value which is maintained for the duration of the discontinuity. In the case of slagging a TBRC, when the vessel is rotated out of alignment with the hood of the off-gas system, the hold signal ramps down to a preselected minimum value. Upon termination of the discontinuity, the hold signal returns smoothly to the frozen value of the control signal and control is returned to the controller. The controller will then ramp at its reset rate to maintain the flow at the set point value.

DESCRIPTION OF THE PREFERRED EMBODIMENTS

Figure 1:
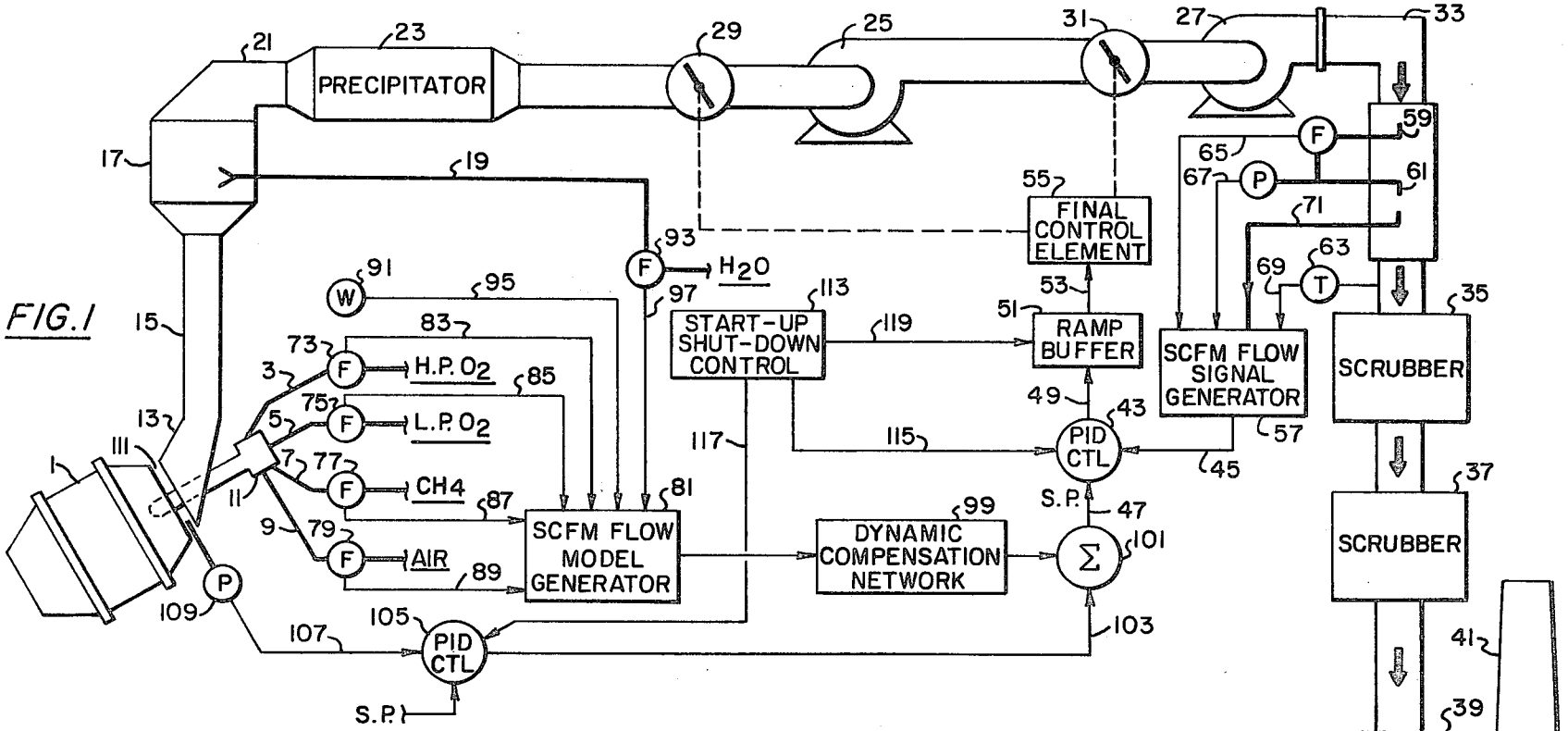
FIG. 1 is a schematic diagram of TBRC off-gas system incorporating the invention.

Although the invention is applicable to off-gas systems for other gas generating processes, it will be described as applied to the off-gas system for a TBRC used to melt copper. Referring to the FIG. 1, the ore concentrates and other solid phase constituents are placed in a TBRC 1 in the proportions and at the times called for by the well known copper smelting processes which form no part of this invention. At various times called for by the process, additional gas phase constituents such as high pressure and low pressure oxygen, natural gas and process air supplied through lines 3, 5, 7 and 9 respectively are introduced into the vessel 1 through a lance 11. The chemical reactions which take place in the vessel 1 generate an off-gas mixture consisting mainly of $SO_2$, CO, $CO_2$, $N_2$, $H_2O$ and $O_2$ which must be treated in an off-gas system before being released to the atmosphere.

The off-gas system includes a hood 13 which collects the hot gases in the vessel and delivers them through a duct 15 to a cooler 17 where water supplied by line 19 is sprayed into the gas stream to lower its temperature. From the cooler, the gases pass through a duct 21 to a precipitator 23 where particulate matter is extracted. The gases then pass through a pair of fans 25 and 27 which provide the motive force for the off-gas system. The fans 25 and 27 are connected in series with each fan regulated by its own damper 29 and 31 respectively.

The fans 25 and 27 propel the off-gases through a duct 33 to one or more scrubbers 35 and 37. For instance, the scrubber 35 can be a venturi type scrubber which removes fine particulate material from the off-gas stream and the scrubber 37 can be a tower type scrubber for removing $SO_2$. The remaining gases then pass through a reheater 39 to raise their temperature, which has been reduced substantially as the gases progress through the system, so that they will rise in the atmosphere when released in stack 41.

The controls for the off-gas system include a controller 43 which applies proportional, integral and derivative control action to the difference between a feedback signal applied to the controller through lead 45 and a set point signal applied through lead 47 to generate a control signal on lead 49. Except under conditions to be described below, the control signal passes through a ramp buffer 51 and is applied by lead 53 to a final control element 55 which mechanically positions the dampers 29 and 31 of fans 25 and 27 respectively as a function of the control signal. A final control element suitable for positioning the dampers on two series connected fans is described in commonly owned patent application Ser. No. 22,769 filed concurrently herewith in the names of William R. Phillips, Jr. and Ronald D. Tate.

The feedback signal applied to the controller 43 by lead 45 represents the actual flow of the off-gases downstream of the fans expressed in terms of standard cubic feet per minute (SCFM). This signal is generated in SCFM Flow Signal Generator 57 as a function of the velocity pressure of the off-gas in duct 33 as measured by pitot tube 59, the static pressure as measured by probe 61, and the temperature as measured by element 63. The signals generated by these devices are applied to the signal generator 57 by leads 65, 67 and 69 respectively. In addition, a sample of the gas flowing in duct 33 is extracted and fed to a mass spectrometer contained in signal generator 57 through a pneumatic line 71. The manner in which the SCFM flow signal is generated by the signal generator will be discussed below.

The portion of the control system described above provides feedback control to maintain the SCFM flow of the off-gases at the set point value provided on lead 47. While this set point value could be manually set, it is an important feature of this invention that the set point of the flow control loop includes components representative of the gas generating inputs to the process vessel 1. Thus flow meters 73, 75, 77 and 79 transmit signals representative of the flow of high pressure $O_2$, low pressure $O_2$, natural gas and process air to a SCFM Flow Model Generator 81 over leads 83, 85, 87 and 89 respectively. In addition, signals representative of the weight of ore concentrate introduced into the process vessel 1 as indicated by weight detector 91 and the flow rate of water into the cooler as indicated by flow meter 93 are applied to the model generator by leads 95 and 97 respectively.

By making certain assumptions about the process, the SCFM Flow Model Generator 81 need only multiply the various input signals by appropriate scaling factors and sum the products to generate a signal representative of the off-gas generation rate in SCFM. First, it is assumed that all of the oxygen, including the oxygen content of the process air, is converted to $SO_2$, $CO_2$ or $H_2O$ with any excess oxygen remaining in a gaseous state. The $H_2O$ is formed by oxidation of the natural gas according to the following formula:

$$CH_4+2O_2 \rightarrow CO_2+2H_2O \quad (1)$$

Some CO is generated by the process; however, since it is a minor constituent and is only present during the coking operation, this reaction is ignored without appreciable affect on the control system. Thus, one SCFM of $O_2$ introduced into the process vessel appears in duct 33 as one SCFM of $SO_2$, $CO_2$ or $O_2$ or combines with one-half SCFM of $CH_4$ and appears in duct 33 as one half SCFM of $CO_2$ and one SCFM of $H_2O$. Since the flows are calculated in SCFM it does not matter in what proportions the off-gases are generated. The nitrogen in the process air does not enter into the reactions carried out in the vessel therefore all of the $N_2$ in the process air appears as $N_2$ in duct 33.

It is further assumed in the SCFM flow model, that the water introduced in the cooler 17 and in the ore concentrates is not chemically affected by the process reactions. In this regard, the only constituent of the ore concentrates which is considered by the SCFM Flow Model Generator is the the water content. It is not necessary to consider the sulfur content of the ore because one mole of the sulfur will combine with one mole of the oxygen to form one mole of $SO_2$ which is thus provided for by the oxygen input as discussed above. For similar reasons, it is not necessary to consider the carbon introduced into the vessel in the form of coke since it will be converted to $CO_2$. It should be clear at this point that the SCFM model of process inputs is much simpler and easier to implement than a mass flow model which would require additional means such as a second mass spectrometer or timing sharing of the mass spectrometer used in the flow control feedback loop to determine the proportion of each gas entering the off-gas system.

The signal representative of the SCFM of off-gases being generated in the vessel 1 is fed forward from the model generator 81 as a component of the set point for the flow controller 43. This permits the fans to accomodate for a change in the rate of production of process off-gases which would otherwise not be detected by the flow control loop for a considerable period of time due to the large volume contained in the cooler 17 and especially the precipitator 23. It is desirable, although not essential to the invention, to enhance the response time of the flow control loop to changes in the off-gas generation rate by applying dynamic compensation to the feed forward signal. Thus, lead compensation is applied to the feed forward signal generated by the SCFM Flow Model Generator 81 in Dynamic Compensation Network 99.

A trim signal is applied to the lead compensated feed forward signal by a summer 101. The trim signal is generated on lead 103 by a controller 105 which applies proportional, integral and derivative control action to the difference between a process pressure signal on lead 107 and a set point signal. The pressure signal is generated by pressure transmitter 109 as a function of the pressure at the gap 111 between the process vessel 1 and the hood 13 of the process off-gas system. This signal which closes a feedback loop for the controller 105 is representative of leakage air and the set point of the controller 105 is selected such that air is continuously being drawn into the off-gas system through the gap 111. Scaling is provided by the summer 101 so that the leakage air is properly accounted for in the feed forward signal on lead 47.

It will be appreciated from FIG. 1 that the two control loops are cascaded with the process off-gas pressure as measured in gap 111 being the independent controlled variable and the SCFM flow of off-gases being the dependent controlled variable. With this arrangement, the amount of leakage air introduced into the system can be kept at a minimum while assuring that a sufficient flow rate will always be maintained to prevent puffing at the gap 111. As an alternative, the controller 105 is switched to manual and operated open loop in which case the set point must be selected high enough to assure that sufficient ambient air will be drawn through the gap 111 under all conditions. It should also be noted that other physical properties of the process off-gases can be regulated by the controller 105 such as off-gas temperature.

When large discontinuities occur in the process such as during start up and shut down and when the hood 13 is removed for slagging operations in the TBRC 1, a Start-up and Shut-down Control 113 applies signals to controllers 43 and 105 over leads 115 and 117 respectively which freeze the controller outputs. It simultaneously triggers the Ramp Buffer 51 over lead 119. When triggered, the Ramp Buffer which normally tracks the output of controller 43, ramps its output down to a preset minimum level to smoothly reduce the off-gas system flow. When triggered again by Start-up and Shut-down Control 113, the Ramp Buffer ramps up to the level of the frozen output of controller 43 whereupon both controllers are released and they ramp to the output called for by existing conditions at their reset rate.

Figure 2:
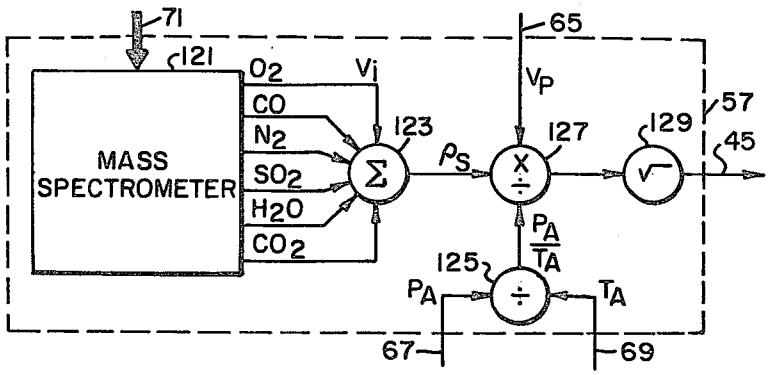
FIG. 2 is a schematic diagram of the SCFM Flow Signal Generator which appears in FIG. 1.

Returning now to the determination of the actual flow rate of the off-gases in duct 33, reference should be made to FIG. 2 wherein the details of the SCFM Flow Signal Generator 57 are illustrated. A sample of the off-gases in duct 33 is delivered through line 71 to a mass spectrometer 121 where the percent by volume ($V_i$) is calculated for each of the major constituents in the off-gas. The summer 123 multiplies the $V_i$ for each constituent by a scale factor which is a function of the density $\rho_i$ of the constituent normalized to standard temperature and pressure and adds the resultant signals together to generate a signal representative of normalized density $\rho_s$ of the total off-gas flow. In order to understand how the off-gas flow rate is developed using this information it is necessary to develop some formulas in which:

$Q_A$=off-gas actual flow
$Q_S$=off-gas flow in SCFM
A=area of duct 33
V=actual velocity of off-gases
$V_P$=velocity pressure of off-gases
$\rho_A$=actual density
$\rho_S$=density at standard temperature & pressure
$P_A$=actual pressure (absolute)

$T_A$=actual temperature (absolute)

The actual flow of the off-gases is determined as follows:

$$Q_A = VA \quad (2)$$

$$\text{Where:} \quad V = 1096.7\sqrt{\frac{V_P}{\rho_A}} \quad (3)$$

Since the flow rate expressed in terms of SCFM is equal to the mass flow rate converted to standard temperature and pressure conditions in accordance with the following formula:

$$Q_S = Q_A(T_S/P_S)(P_A/T_A) \quad (4)$$

and since the actual density may be related to the density at standard conditions by the following formula:

$$\rho_A = \rho_S(P_A/T_A)(T_S/P_S) \quad (5)$$

the flow in SCFM can be determined by substituting formulas 2, 3 and 5 into formula 4 to arrive at:

$$Q_s = A \cdot 1096.7 \frac{T_S}{T_A} \frac{P_A}{P_S} \sqrt{\frac{V_P}{\rho_S} \frac{T_S}{T_A} \frac{P_A}{P_S}} \quad (6)$$

Since the area A of duct 33 is fixed and since the standard temperature and pressure are constants all these terms may be combined into single constant K and formula 6 may be rearranged to arrive at:

$$Q_S = K\sqrt{\frac{V_P}{\rho_S} \frac{P_A}{T_A}} \quad (7)$$

This solution for off-gas flow is SCFM is performed by the circuit of FIG. 2. As indicated therein, the actual pressure signal on lead 67 and the actual temperature signal on lead 69 are applied to divider 125 to generate the last term under the radical and this signal is combined with the velocity pressure signal on line 65 and the normalized density signal from summer 123 in multiplier/divider 127 to generate the full term under the radical. The square root of this signal is then calculated and multiplied by the constant K in circuit 129 to produce the SCFM flow feedback signal on line 45.

While specific embodiments of the invention have been described in detail it will be appreciated by those skilled in the art that various modifications and alternatives to the details disclosed herein could be developed which would still fall fully within the scope of the invention. For instance, while the invention has been described as being implemented by hardware it could also be implemented by software. Accordingly, the particular arrangements disclosed are meant to be illustrative only and not as limiting on the scope of the invention which is to be given the full breadth of the appended claims and any and all equivalents thereof.

We claim:

1. A method of controlling a process off-gas system in which a plurality of gases are generated in a process vessel in varying proportions during various stages of the process and are drawn through treatment equipment by fan means including a fan and means for controlling the capacity of the fan, said process comprising the steps of:

determining on a real time basis the actual flow rate of the off-gases down stream of the fan means by measuring the amount by percent volume of each of the major constituents present in the off-gases, measuring the temperature and pressure of said off-gases and using said amounts, pressure and temperature to generate the downstream actual flow rate which is the combined flow rate of said major constituents corrected for temperature and pressure, generating a set point value for said downstream actual off-gas flow rate by measuring on a real time basis the inputs of off-gas producing materials to the process vessel, and determining the flow rate of the off-gas that will be generated by the process as a function of the measured process inputs, comparing the actual flow rate with a set point value for the flow, and controlling the fan means to adjust the flow of off-gases to maintain the actual flow rate at the set point value.

2. The method of claim 1 including adding a trim factor to said input flow rate to generate a trimmed set point value and regulating the fan means to maintain the downstream actual flow rate of the off-gases at the trimmed set point value.

3. The method of claim 2 wherein said trim factor is generated by monitoring on a real time basis a selected physical property of the off-gases at the process vessel, and applying control action to the difference between said monitored off-gas property and a preselected off-gas property set point value.

4. The method of claim 3 wherein the selected physical off-gas property is the off-gas pressure.

5. The method of claim 4 wherein the process off-gas system is connected to the process vessel by a hood and wherein there is a gap between the hood and the vessel, said process pressure being monitored in the vicinity of said gap and said process pressure set point being selected to assure leakage of ambient air through said gap into the process off-gas system.

6. The method of claim 2 wherein the process off-gas system is connected to the process vessel by a hood and wherein there is a gap between the hood and vessel, said trim factor being selected to provide sufficient downstream off-gas flow to assure that ambient air is drawn into the process off-gas system at all times.

7. The method of claim 1 including applying lead compensation to the input flow rate to generate a lead compensated set point value and regulating the fan means to maintain the downstream actual flow rate of the off-gases at the lead compensated set point value.

8. The method of claim 1 adapted for the accomodation of discontinuities in the flow rate of off-gases through the off-gas system wherein the step of controlling the fan means comprises adjusting the output of the fan system as a function of a signal applied to a fan means final control element, generating a control signal by applying said difference between the down-stream actual flow rate of the off-gases and the set point value thereof to a controller having a preselected reset rate, applying the control signal to the final control element to regulate fan output, freezing the value of the control signal generated by the controller while disconnecting the same from the final control element upon the occurence of a discontinuity of predetermined magnitude in the flow of off-gases to the off-gas system, applying to the final control element a hold signal which has an initial value equal to the frozen value of the control signal and which changes smoothly in value to a preselected interim value which is maintained for the duration of said discontinuity, adjusting the hold signal to smoothly return the value thereof to the frozen value of the control signal upon the termination of the discontinuity in the off-gas flow to the off-gas system, and reapplying the control signal in place of the hold signal to the final control element and unfreezing the value of the control signal generated by the controller to return the system to automatic flow control at the reset rate of the controller.

9. The method of claim 1 wherein the input flow rate and the downstream actual flow rate are determined in terms of mass flow.

10. The method of claim 1 wherein the input flow rate and the downstream actual flow rate are determined in terms of SCFM.

11. The method of claim 10 wherein the SCFM flow of gases into the off-gas system is approximated by generating input signals representative of the flow rates of the major off-gas generating inputs to the process vessel, applying selected linear scaling to said input signals and summing the resultant signals.

* * * * *